US011470694B2

(12) United States Patent
Kwack et al.

(10) Patent No.: US 11,470,694 B2
(45) Date of Patent: Oct. 11, 2022

(54) INDUCTION HEATING DEVICE PERFORMING CONTAINER SENSING FUNCTION

(71) Applicant: LG Electronics Inc., Seoul (KR)

(72) Inventors: Younghwan Kwack, Seoul (KR); Kyelyong Kang, Seoul (KR); Seongho Son, Seoul (KR); Seonho Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 697 days.

(21) Appl. No.: 16/390,665

(22) Filed: Apr. 22, 2019

(65) Prior Publication Data

US 2020/0029397 A1 Jan. 23, 2020

(30) Foreign Application Priority Data

Jul. 18, 2018 (KR) ..... 10-2018-0083728
Nov. 20, 2018 (KR) ..... 10-2018-0143996

(51) Int. Cl.
*H05B 6/06* (2006.01)
*H05B 6/12* (2006.01)

(52) U.S. Cl.
CPC ..... *H05B 6/062* (2013.01); *H05B 6/1236* (2013.01)

(58) Field of Classification Search
CPC ... H05B 2213/05; H05B 6/1236; H05B 6/062
See application file for complete search history.

(56) References Cited

U.S. PATENT DOCUMENTS

2013/0327842 A1* 12/2013 Seiler ..... B60H 1/2218 219/486

FOREIGN PATENT DOCUMENTS

| | | | |
|---|---|---|---|
| EP | 2999302 | | 3/2016 |
| JP | S5199344 | | 9/1976 |
| JP | 2005142097 | | 6/2005 |
| JP | 2016042431 | | 3/2016 |
| KR | 19990017237 A | * | 3/1999 |
| WO | WO2013064331 | | 5/2013 |

OTHER PUBLICATIONS

Extended European Search Report in European Application No. 19166931.6, dated Nov. 31, 2019, 8 pages.

* cited by examiner

*Primary Examiner* — Dana Ross
*Assistant Examiner* — Kuangyue Chen
(74) *Attorney, Agent, or Firm* — Fish & Richardson P.C.

(57) ABSTRACT

An induction heating device includes an induction heating circuit, a sensor configured to measure current applied to the induction heating circuit, and a controller. The controller includes: a switch driving unit configured to control operation of an inverter unit and to allow a resonance of the current, a container sensing unit, and a control unit. The container sensing unit is configured to: convert a first current value before the resonance into a first voltage value; control the switch driving unit to charge a working coil; compare the first voltage value with a resonance reference value; convert a second current value after the resonance into a second voltage value; generate one or more output pulses; and compare the second voltage value with a count reference value. The control unit is configured to determine whether an object is present on the working coil based on the one or more output pulses.

20 Claims, 11 Drawing Sheets

INDUCTION HEATING DEVICE PERFORMING CONTAINER SENSING FUNCTION

CROSS-REFERENCE TO RELATED APPLICATIONS

This application claims priority under 35 U.S.C. § 119 to Korean Application No. 10-2018-0083728, filed on Jul. 18, 2018, and Korean Application No. 10-2018-0143996, filed on Nov. 20, 2018, whose entire disclosure is herein incorporated by reference.

TECHNICAL FIELD

The present disclosure relates to an induction heating device performing a container sensing function.

BACKGROUND

An induction heating device may cause a high-frequency current to flow in a working coil or a heating coil. The high-frequency current may generate a strong magnetic field line. In some cases, when the magnetic field line passes through a cooking container placed on the heating coil, an eddy current may be generated in the cooking container.

For example, as a current is applied to the heating coil, an induction heating phenomenon may occur in the cooking container made of a magnetic material. Heat generated by induction heating may increase a temperature of the cooking container.

A recent induction heating device has a container sensing function to sense whether or not the cooking container is present on the heating coil.

Hereinafter, an induction heating device in related art will be described.

FIG. 1 illustrates an induction heating device in related art having a container sensing function.

Referring to FIG. 1, the induction heating device includes a power supply unit 61, a switching unit 62, a working coil 63, a zero-point detection unit 64, a control unit 65, and a current conversion unit 66.

Specifically, the power supply unit 61 supplies a direct current (DC) to the switching unit, and the switching unit 62 supplies a resonant current to the working coil through a switching operation. The zero-point detection unit 64 detects a zero-point of commercial power and transmits a zero-point signal to the control unit 65. The current conversion unit 66 measures a resonant current flowing through the working coil 63 and transmits a voltage fluctuation waveform to the control unit 65. The control unit 65 controls an operation of the switching unit 62 based on the zero-point signal and the voltage fluctuation waveform supplied from the zero-point detection unit 64 and the current conversion unit 66, respectively.

The control unit 65 calculates a voltage value based on the supplied zero-point signal and the voltage fluctuation waveform. When the calculated voltage value deviates from a predetermined variation range, the control unit 65 determines that no container 70 is present on the working coil 63.

In some cases, the induction heating device determines whether or not the container 70 is present on the working coil 63 only at a zero-point time point (i.e., zero-voltage time point) of an input voltage (e.g., commercial power). In this case, accuracy in sensing a container may be low, and power consumption may be high.

In some cases, when the input voltage outputted from the power supply unit 61 is changed, the induction heating device may not accurately sense a container. For example, when an adjacent working coil operates, an input voltage applied to a working coil to be sensed may be lowered. In this case, accuracy in sensing a cooking container may be lowered.

SUMMARY

The present disclosure provides an induction heating device that is configured to perform a container sensing function and that is configured to operate with low power consumption and respond rapidly.

The present disclosure further provides an induction heating device that may stably perform a container sensing operation regardless of whether or not an adjacent working coil operates or a change in input power.

According to one aspect of the subject matter described in this application, an induction heating device includes an induction heating circuit configured to drive a working coil, the induction heating circuit including an inverter unit, a sensor configured to measure a current applied to the induction heating circuit, and a controller configured to control the induction heating circuit based on a current value of the current measured by the sensor. The controller includes a switch driving circuit configured to control operation of the inverter unit and to allow a resonance of the current, The controller includes a plurality of circuits that are configured to convert a first current value measured before the resonance into a first voltage value, based on conversion of the first current value to the first voltage value, control the switch driving circuit to charge the working coil with energy, compare the first voltage value with a predetermined resonance reference value, convert a second current value measured after the resonance into a second voltage value, based on conversion of the second current value into the second voltage value, generate one or more output pulses, and compare the second voltage value with a predetermined count reference value. The controller is configured to determine whether an object is present on the working coil based on the one or more output pulses.

Implementations according to this aspect may include one or more of the following features. For example, the container sensing unit may include: a resonant current conversion unit configured to convert the first current value into the first voltage value and convert the second current value into the second voltage value; a shutdown comparison unit configured to generate an output signal based on comparing the first voltage value with the predetermined resonance reference value; a count comparison unit configured to generate the one or more output pulses based on comparing the second voltage value with the predetermined count reference value; and a shutdown circuit unit configured to control the switch driving unit based on the output signal and to allow the resonance of the current.

In some implementations, the inverter unit may include a first switching element and a second switching element that are configured to be turned on and turned off based on a switching signal supplied from the switch driving unit. In some examples, the shutdown comparison unit is configured to generate the output signal based on the first voltage value being greater than the predetermined resonance reference value. In some examples, the container sensing unit further may include a latch circuit unit connected to ends of the shutdown comparison unit and configured to maintain an activation state of the output signal of the shutdown comparison unit for a predetermined period of time.

In some implementations, the control unit is further configured to determine whether or not the object is present on the working coil based on comparing a count of a number of the one or more output pulses with a predetermined reference count or comparing an on-duty time of the one or more output pulses with a predetermined reference time. In some examples, the count may include a number of times at which the one or more output pulses are switched from an off-state to an on-state, where the control unit is further configured to: determine that the object is present on the working coil based on the count being less than the predetermined reference count, and determine that the object is not present on the working coil based on the count being greater than the predetermined reference count.

In some examples, the on-duty time of the one or more output pulses may include an accumulated time of the on-state of the one or more output pulses, where the control unit is further configured to: determine that the object is present on the working coil based on the on-duty time being less than the predetermined reference time, and determine that the object is not present on the working coil based on the on-duty time being greater than the predetermined reference time.

In some implementations, the control unit is further configured to: compare a variation amount of a voltage applied to the inverter unit with a predetermined variation reference value; and based on a result of the comparison of the variation amount of the voltage with the predetermined variation reference value, determine an on-state duration of a single pulse to be supplied to the shutdown circuit unit. In some examples, the control unit is further configured to: based on the variation amount of the voltage being less than the predetermined variation reference value, supply a first single pulse having a first on-state duration to the shutdown circuit unit; and based on the variation amount of the voltage being greater than the predetermined variation reference value, supply a second single pulse having a second on-state duration greater than the first on-state duration to the shutdown circuit unit.

In some implementations, the control unit is further configured to determine whether or not the object is present on the working coil in a state in which a voltage applied to the inverter unit is less than a predetermined reference voltage. In some examples, the control unit is configured to, based on an induction current being induced to the working coil by operation of another working coil disposed within a range from the working coil, determine whether or not the object is present on the working coil in a state in which the induction current is less than a predetermined reference current.

In some implementations, the controller may include a first controller configured to control a first working coil and a second controller configured to control a second working coil, where the first working coil and the second working coil are connected to one power source. In the same or other implementations, the first controller may be configured to determine whether an object is present on the first working coil based on an induced current in the first working coil induced by operation of the second working coil.

In some implementations, the container sensing unit is further configured to control the switch driving unit to charge the working coil with energy having a constant magnitude. In some implementations, a node between the first switching element and the second switching element is connected to a first end of the working coil, and the sensor is connected to a second end of the working coil. In some examples, each of the first switching element and the second switching element may include an insulated gate bipolar transistor.

In some examples, the first switching element is configured to be turned on based on the second switching element being turned off, and the first switching element is configured to be turned off based on the second switching element being turned on. In some examples, the count comparison unit is configured to generate the one or more output pulses based on the second voltage value being greater than the predetermined count reference value.

In some implementations, the control unit is further configured to supply a pulse signal to the shutdown circuit unit, and the shutdown circuit unit is configured to transmit the output signal to the switch driving unit based on the pulse signal received from the control unit. In some implementations, the switch driving unit is configured to generate the switching signal based on the output signal received from the shutdown circuit unit.

The present disclosure are not limited to the above-described aspects, and the other aspects and advantages of the present disclosure will become apparent from the following description of implementations. In addition, it is easily understood that the aspects and advantages of the present disclosure can be achieved by the means described in the claims and a combination thereof.

In some implementations, the induction heating device may perform a container sensing operation by using a single pulse in a particular section based on a zero-crossing time point, and thus may operate with low power consumption and respond rapidly.

In some implementations, the induction heating device may include a control unit configured to adjust a length of the single pulse according to a variation amount of the input voltage, thereby stably performing the container sensing operation.

In some implementations, the induction heating device may operate with low power consumption respond rapidly, reduce or prevent waste of electric power, and improve a user's satisfaction.

In some implementations, the induction heating device may stably perform the container sensing operation regardless of whether or not an adjacent working coil operates or a change in input power, thereby improving the accuracy and operation reliability of the container sensing function. In some examples, the induction heating may prevent an over-current from flowing when performing the container sensing function, and reduce or prevent a noise resulting from the over-current.

In addition to the above described effect, a specific effect of the present disclosure will be described together with a specific matter for implementing the disclosure.

DETAILED DESCRIPTION

Figure 1:
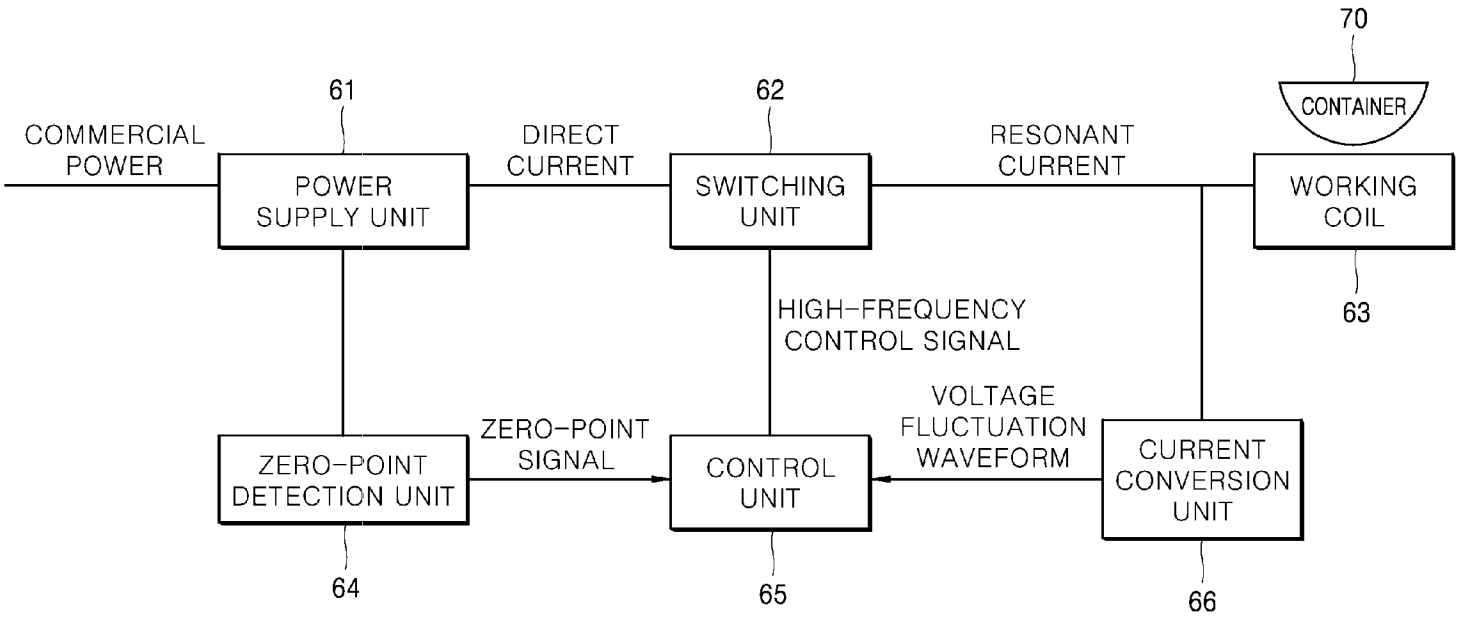
FIG. 1 Related Art
FIG. 1 is a block diagram illustrating an induction heating device in related art.

The above-described aspects, features and advantages will be described in detail with reference to the accompanying drawings so that those skilled in the art can easily carry out the present disclosure. In relation to describing the present disclosure, the detailed description of well-known related configurations or functions can be omitted when it is deemed that such description may cause ambiguous interpretation of the present disclosure. Hereinafter, one or more implantations according to the present disclosure will be described with reference to the accompanying drawings. Same or like reference numerals designate same or like components throughout the specification.

Further, it should be noted that, when it is described in the specification that one component is "connected," "coupled" or "joined" to another component, the former may be directly "connected," "coupled," and "joined" to the latter or "connected," "coupled," and "joined" to the latter via another component.

Hereinafter, an induction heating device will be described in detail with reference to FIGS. 2 to 11B.

Figure 2:
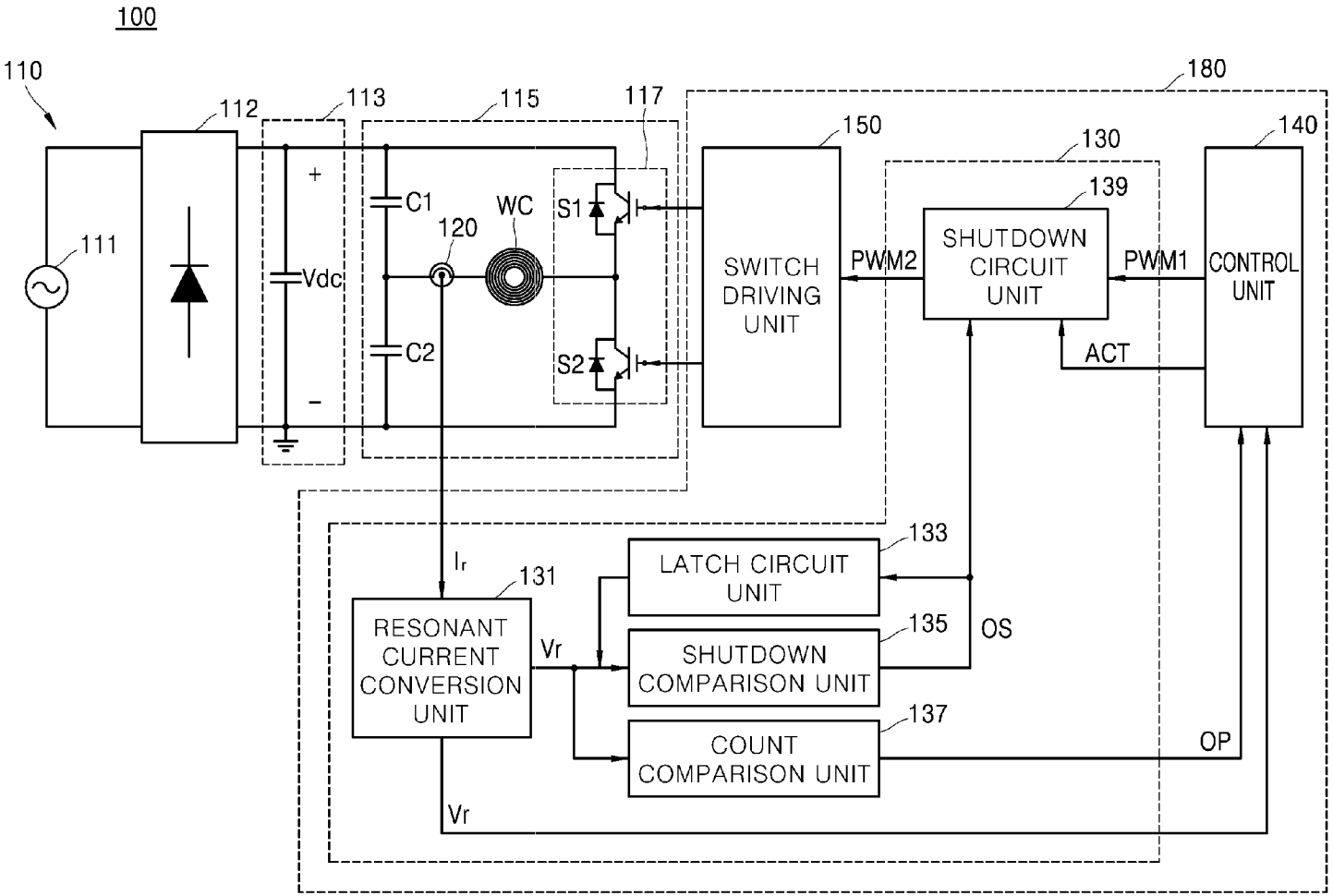
FIG. 2 is a schematic diagram illustrating an example induction heating device according to an implementation of the present disclosure.
Figure 3:
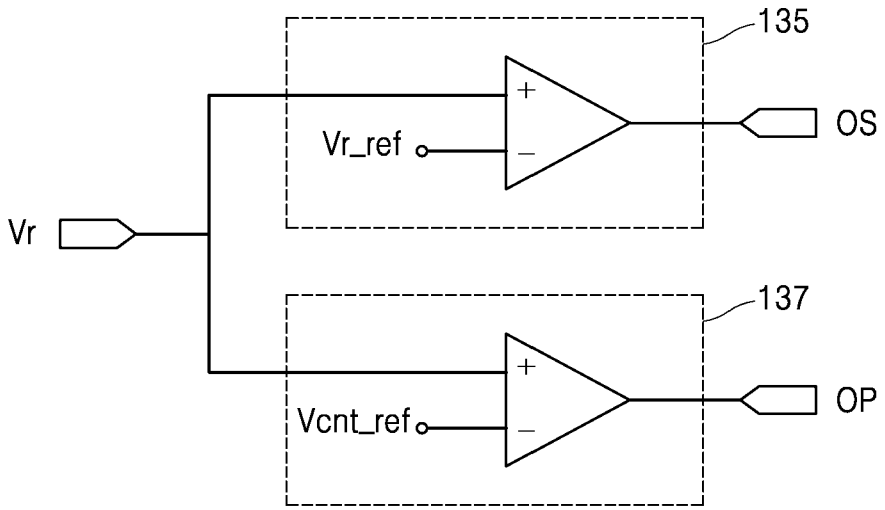
FIG. 3 is a schematic diagram illustrating an example shutdown comparison unit and an example count comparison unit of FIG. 2.

FIG. 2 is a schematic diagram illustrating an example induction heating device according to an implementation of the present disclosure. FIG. 3 is a schematic diagram illustrating an example shutdown comparison unit and an example count comparison unit of FIG. 2.

Referring to FIGS. 2 and 3, an induction heating device 100 may include an induction heating circuit 110 configured to drive a working coil WC, a sensor configured to measure a current flowing through the working coil WC, and a controller 180 configured to control the induction heating circuit 110 based on the current measured by the sensor 120.

In some examples, the induction heating circuit 110 may include a power supply unit 111, a rectification unit 112, a direct current (DC) link capacitor 113, and an induction heating unit 115.

The power supply unit 111 may output alternating current (AC) power.

Specifically, the power supply unit 111 may output and supply the AC power to the rectification unit 112, and may be a commercial power source, for example.

The rectification unit 112 may convert the AC power supplied from the power supply unit 111 into DC power and supply the DC power to an inverter unit 117.

Specifically, the rectification unit 112 may rectify the AC power supplied from the power supply unit 111 and convert the rectified AC power into DC power. Also, the rectification unit 112 may supply the converted DC power to the DC link capacitor 113.

In some implementations, the rectification unit 112 may include a bridge circuit composed of one or more diodes, but is not limited thereto.

The DC link capacitor 113 may receive the DC power from the rectification unit 112, and may reduce a ripple of the received DC power. The DC link capacitor 113 may also include a smoothing capacitor, for example.

In addition, the DC link capacitor 113 may receive the DC power from the rectification unit 112, and thus, a DC voltage Vdc (hereinafter, referred to as an input voltage) may be applied to opposite ends of the DC link capacitor 113.

As a result, the DC power (or DC voltage) that is rectified by the rectification unit 112 and has a ripple reduced by the DC link capacitor 113 may be supplied to the inverter unit 117.

The induction heating unit 115 may drive the working coil WC.

Specifically, the induction heating unit 115 may include the inverter unit 117 and a resonant capacitor unit (e.g., C1 and C2).

In some implementations, the inverter unit 117 may include two switching elements S1 and S2. The first and second switching elements S1 and S2 may be alternately turned on or off by a switching signal supplied from a switch driving unit 150 to convert the DC power into a high-frequency AC (that is, a resonant current). As a result, the converted high-frequency AC may be supplied to the working coil WC.

In some implementations, the first and second switching elements S1 and S2 may include, for example, an insulated gate bipolar transistor (IGBT), but are not limited thereto.

The resonant capacitor unit may include first and second resonant capacitors C1 and C2 respectively connected in parallel to the first and second switching elements S1 and S2.

Specifically, when a voltage is applied by a switching operation of the inverter unit 117, the resonant capacitor units C1 and C2 may begin to resonate. When the resonant capacitor units C1 and C2 resonate, a current flowing through the working coil WC connected to the resonant capacitor units C1 and C2 may rise.

Through this process, an eddy current may be induced to an object to be heated (for example, a cooking container) disposed on the working coil WC connected to the resonant capacitor units C1 and C2.

In some implementations, the working coil WC may include, for example, at least one of a single coil structure composed of a single coil, a dual coil structure separated into an inner coil and an outer coil, and a multi-coil structure composed of a plurality of coils.

The sensor 120 may measure a current value Ir of the current flowing through the working coil WC.

Specifically, the sensor 120 may be connected in series with the working coil WC, and may measure the current value Ir of the current flowing through the working coil WC.

In some implementations, the sensor 120 may include, for example, a current measuring sensor configured to directly measure the current value of the current, or may include a current transformer.

When the sensor 120 includes the current measuring sensor, the sensor 120 may directly measure the current value Ir of the current flowing through the working coil WC and supply the measured current value Ir to a resonant current conversion unit 131 to be described later. When the sensor 120 includes the current transformer, the sensor 120 may convert a magnitude of the current flowing through the working coil WC via the current transformer and supply the current having the converted magnitude to the resonant current conversion unit 131.

But, for ease of explanation, a configuration in which the sensor 120 includes the current measuring sensor configured to directly measure the current value Ir of the current flowing through the working coil WC will be described as an example.

The controller 180 may include a container sensing unit 130, a control unit 140, and a switch driving unit 150.

In some implementations, the container sensing unit 130 may determine a state of a second pulse signal PWM2 (in particular, PWM2-HIN of FIG. 4) to be supplied to the switch driving unit 150 based on the current value of the current measured by the sensor 120.

The controller 180 may include the resonant current conversion unit 131, latch circuit unit 133, shutdown comparison unit 135, count comparison unit 137, and shutdown circuit unit 139.

Specifically, the resonant current conversion unit 131 may convert the current value Ir of the current measured by the sensor 120 into a voltage value Vr. The resonant current conversion unit 131 may also transmit the converted voltage value Vr to each of the shutdown comparison unit 135, the count comparison unit 137 and the control unit 140.

That is, the resonant current conversion unit 131 may convert the current value Ir of the current supplied from the sensor 120 into the voltage value Vr, and may transmit the converted voltage value Vr to each of the shutdown comparison unit 135, the count comparison unit 137 and the control unit 140.

Here, the voltage value supplied to the shutdown comparison unit 135 by the resonant current conversion unit 131 may be different from the voltage value supplied to the count comparison unit 137 by the resonant current conversion unit 131, and details thereof will be described later.

In some implementations, the resonant current conversion unit 131 is not an essential component, and thus may be omitted. In this case, the current value Ir of the current measured by the sensor 120 may be transmitted to the shutdown comparison unit 135, the count comparison unit 137 and the control unit 140.

But, for ease of explanation, a configuration in which the resonant current conversion unit 131 is included in the induction heating device 100 will be described as an example.

The shutdown comparison unit 135 may compare whether or not the voltage value Vr supplied from the resonant current conversion unit 131 is greater than a predetermined resonance reference value Vr_ref.

Specifically, the shutdown comparison unit 135 may compare the voltage value Vr supplied from the resonant current conversion unit 131 with the predetermined resonance reference value Vr_ref.

That is, when the voltage value Vr supplied from the resonant current conversion unit 131 is greater than the predetermined resonance reference value Vr_ref, the shutdown comparison unit 135 may activate an output signal OS. On the other hand, when the voltage value Vr supplied from the resonant current conversion unit 131 is less than the predetermined resonance reference value Vr_ref, the shutdown comparison unit 135 may deactivate the output signal OS.

In some examples, activating the output signal OS may include outputting the output signal OS at a high level (for example, "1"), and deactivating the output signal OS may include outputting the output signal OS at a low level (for example, "0").

The output signal OS of the shutdown comparison unit 135 may be supplied to the shutdown circuit unit 139.

The state of the second pulse signal PWM2 (in particular, PWM2-HIN of FIG. 4) outputted from the shutdown circuit unit 139 may be determined according to whether or not the output signal OS is activated, and details thereof will be described later.

The latch circuit unit 133 may maintain an activation state of the output signal OS outputted from the shutdown comparison unit 135 for a predetermined period of time.

Specifically, when the output signal OS of the shutdown comparison unit 135 is activated, the latch circuit unit 133 may maintain the activation state of the output signal OS outputted from the shutdown comparison unit 135 for a predetermined period of time.

The count comparison unit 137 may compare whether or not the voltage value Vr supplied from the resonant current conversion unit 131 is greater than a predetermined count reference value Vcnt_ref, and may output one or more output pulses OP based on a result of comparison.

Specifically, when the voltage value Vr supplied from the resonant current conversion unit 131 is greater than the predetermined count reference value Vcnt_ref, the count comparison unit 137 may output the one or more output pulses OP that is in an on-state.

When the voltage value Vr supplied from the resonant current conversion unit 131 is less than the predetermined count reference value Vcnt_ref, the count comparison unit 137 may output the one or more output pulses OP that is in an off-state.

In some examples, the one or more output pulses OP that is in the on-state may have a logic value of "1," and the one or more output pulses OP that is in the off-state may have a logic value of "0."

Accordingly, the one or more output pulses OP outputted from the count comparison unit 137 may be in the form of a square wave in which the on-state and off-state are repeated.

In some implementations, the one or more output pulses OP outputted from the count comparison unit 137 may be supplied to the control unit 140.

Accordingly, the control unit 140 may determine whether or not an object to be heated is present on the working coil WC based on a count or on-duty time of the one or more output pulses OP supplied from the count comparison unit 137.

The shutdown circuit unit 139 may supply the second pulse signal PWM2 for a container sensing operation to the switch driving unit 150.

Specifically, the shutdown circuit unit 139 may supply the second pulse signal PWM2 to the switch driving unit 150, and the switch driving unit 150 may complementarily turn on or off the first and second switching elements S1 and S2 included in the inverter unit 117 based on the second pulse signal PWM2.

Here, the second pulse signal PWM2 may include a signal (PWM2-HIN of FIG. 4) configured to control turning on or turning off of the first switching element S1 and a signal (PWM2-LIN of FIG. 4) configured to control turning on or turning off of the second switching element S2

In some implementations, the state of the second pulse signal PWM2 (in particular, PWM2-HIN of FIG. 4) of the shutdown circuit unit 139 may be determined according to whether or not the output signal OS supplied from the shutdown comparison unit 135 is activated.

Specifically, when the output signal OS is activated, the shutdown circuit unit 139 may supply the second pulse signal that is in the off-state (i.e., PWM2-HIN that is at a low level (logical value of "0")) to the switch driving unit 150.

That is, the shutdown circuit unit 139 may turn off the first switching element S1 by supplying the second pulse signal that is in the off-state (e.g., PWM2-HIN of FIG. 4) to the switch driving unit 150.

When the output signal OS is deactivated, the shutdown circuit unit 139 may supply the second pulse signal that is in the on-state (e.g., PWM2-HIN that is at a high level (logic value of "1")) to the switch driving unit 150.

That is, the shutdown circuit unit 139 may turn on the first switching element S1 by supplying the second pulse signal that is in the on-state (i.e., PWM2-HIN of FIG. 4) to the switch driving unit 150.

The control unit 140 may control the shutdown circuit unit 139 and the switch driving unit 150.

Specifically, the control unit 140 may control the switch driving unit 150 by supplying the first pulse signal PWM1 to the shutdown circuit unit 139.

Further, the control unit 140 may receive the one or more output pulses OP from the count comparison unit 137.

Specifically, the control unit 140 may determine whether or not the object to be heated is present on the working coil WC based on the count or the on-duty time of the one or more output pulses OP supplied from the count comparison unit 137.

When it is determined that the object to be heated is present on the working coil WC, the control unit 140 may control the switch driving unit 150 to activate (i.e., drive) the corresponding working coil WC.

In some examples, the count may include the number of times at which the one or more output pulses OP are changed from the off-state to the on-state, and the on-duty time may include an accumulated time for the on-state of the one or more output pulses OP during the time when free resonance of the resonance current occurs (e.g., D3 of FIG. 4) in a current flow section including the working coil WC and the second switching element S2.

The control unit 140 may also display whether or not the object to be heated is sensed through a display unit or an input interface unit or may notify a user whether or not the object to be heated is sensed through a notification sound.

In some implementations, the control unit 140 may include a micro controller configured to output a first pulse signal PWM1 having a constant magnitude (e.g., a single pulse (1-Pulse of FIG. 4)), but is not limited thereto.

The control unit 140 may also sense or receive (e.g., receive from the sensor 120) information about a voltage (e.g., input voltage) applied to the inverter unit 117, and may adjust a length of the single pulse (i.e., on-state duration time of the single pulse) based on a variation amount and the like of the received voltage, and details thereof will be described later.

The switch driving unit 150 may be driven based on a driver driving voltage supplied from an external power source, and may be connected to the inverter unit 117 to control a switching operation of the inverter unit 117.

Also, the switch driving unit 150 may control the inverter unit 117 based on the second pulse signal PWM2 supplied from the shutdown circuit unit 139. That is, the switch driving unit 150 may turn on or off the first and second switching elements S1 and S2 included in the inverter unit 117 based on the second pulse signal PWM2.

In some implementations, the switch driving unit 150 may include first and second sub switch driving units configured to turn on or off the first and second switching elements S1 and S2, respectively. Details thereof are omitted.

Hereinafter, a method for sensing a container by the induction heating device of FIG. 2 will be described with reference to FIGS. 4 to 6.

Figure 4:
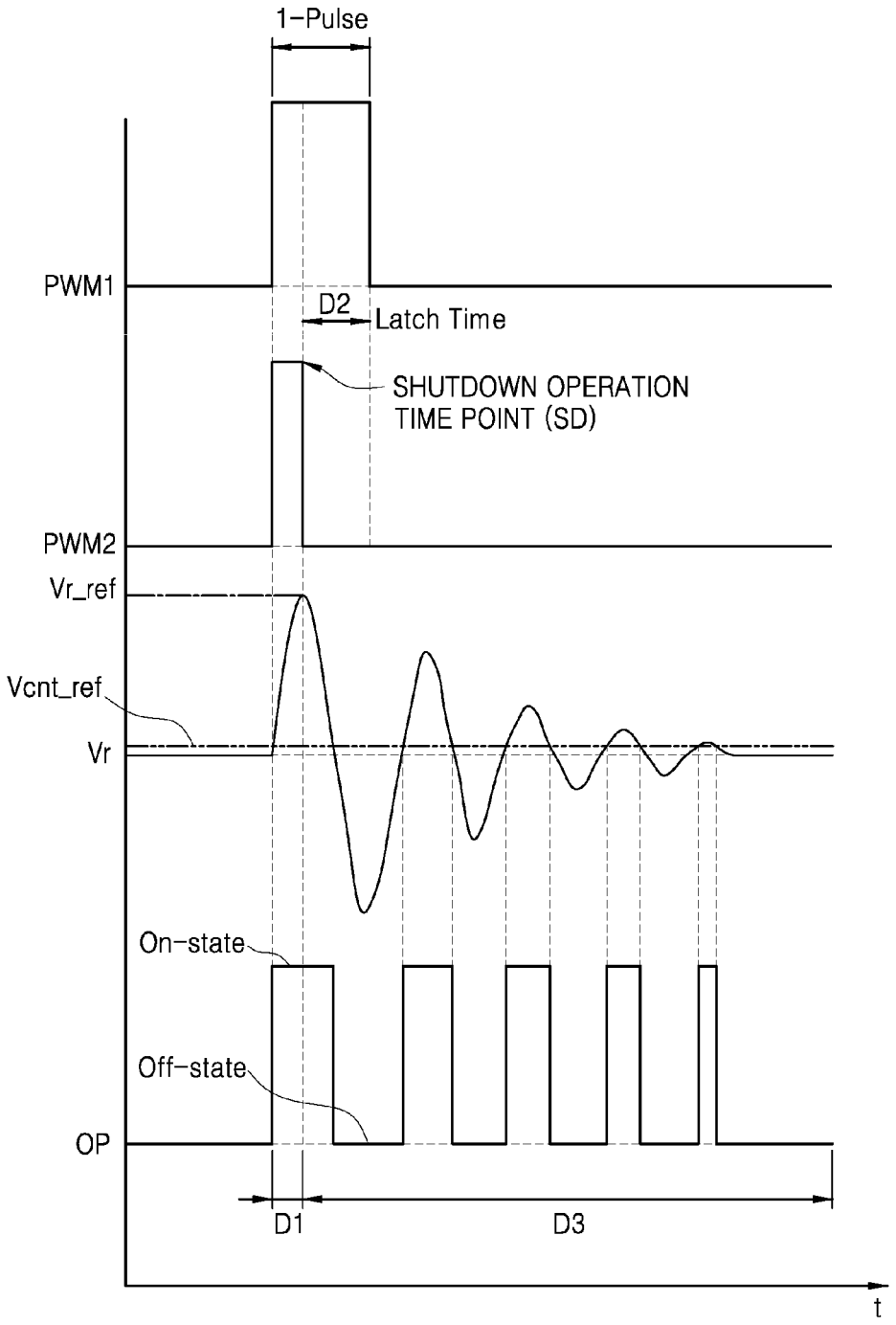
FIG. 4 is a graph illustrating an example method for sensing a container by the induction heating device of FIG. 2.

FIG. 4 is a graph illustrating an example method for sensing a container by the induction heating device of FIG. 2. FIGS. 5 and 6 illustrate an example method for sensing a container by the induction heating device of FIG. 2

Figure 5:
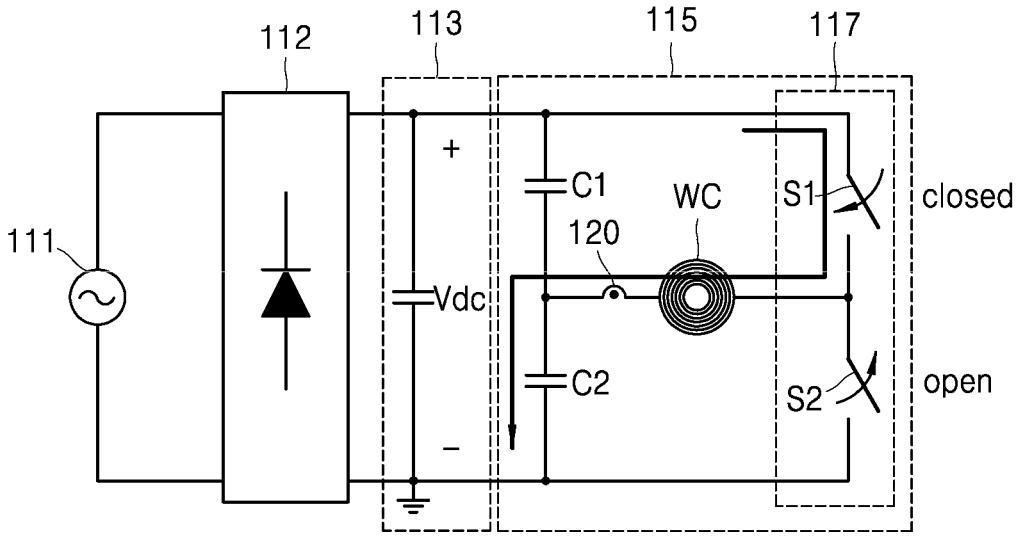
FIGS. 5 and 6 illustrate an example method for sensing a container by the induction heating device of FIG. 2.
Figure 6:
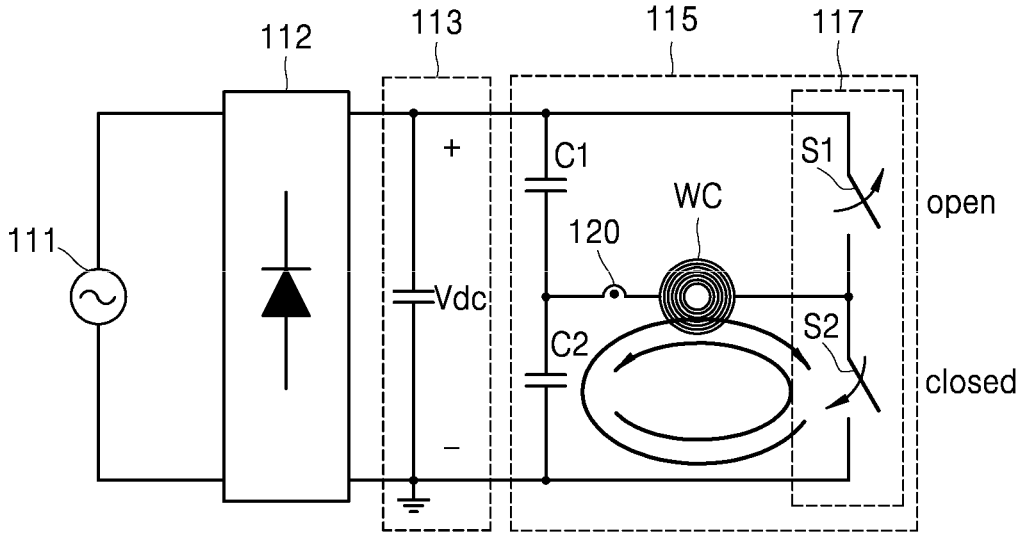

In FIGS. 5 and 6, the above-described controller 180 is omitted for ease of explanation.

Referring to FIGS. 2, 4 and 6, the control unit 140 may supply the first pulse signal PWM1 to the shutdown circuit unit 139. For instance, the control unit 140 may supply a single pulse 1-Pulse to the shutdown circuit unit 139.

The shutdown circuit unit 139 may transmit the second pulse signal PWM2 to the switch driving unit 150 based on the single pulse 1-Pulse supplied from the control unit 140.

Here, as illustrated in FIGS. 4 and 5, while the second pulse signal PWM2 (i.e., PWM2-HIN) is inputted from the shutdown circuit unit 139, the switch driving unit 150 may turn on the first switching element S1 and turn off the second switching element S2.

In this process, the DC link capacitor 113 and the working coil WC to which the input voltage Vdc is applied may form a current flow section, and energy of the input voltage Vdc may be transmitted to the working coil WC. Accordingly, a current passing through the working coil WC may flow along the current flow section.

The sensor 120 may measure a current value Ir of the current passing through the working coil WC and transmit the measured current value Ir to the resonant current conversion unit 131. The resonant current conversion unit 131 may convert the measured current value Ir (current value before free resonance) to a voltage value Vr (i.e., first voltage value), and may supply the converted voltage value Vr to the shutdown comparison unit 135.

The shutdown comparison unit 135 may compare the voltage value Vr supplied from the resonant current conversion unit 131 with the predetermined resonance reference value Vr_ref.

When the supplied voltage value Vr is greater than the predetermined resonance reference value Vr_ref, the shutdown comparison unit 135 may supply the activated output signal OS to the shutdown circuit unit 139. A time point when the shutdown circuit unit 139 receives the activated output signal OS from the shutdown comparison unit 135 may correspond to a shutdown operation time point SD.

That is, the working coil WC may be charged with the input voltage Vdc during the period of time D1. When the working coil WC is sufficiently charged with the energy and exceeds a predetermined threshold value (i.e., predetermined resonance reference value Vr_ref), the shutdown circuit unit 139 may supply the second pulse signal PWM2 (i.e., PWM2-HIN) that is in the off-state to the switch driving unit 150 so that the working coil WC is no longer charged.

Accordingly, the shutdown circuit unit 139 may control the switch driving unit 150 so that a constant magnitude of energy is stored in the working coil WC. As a result, when the free resonance of the resonant current occurs in the current flow section including the working coil WC and the second switching element S2, the free resonance may constantly occur, thereby improving accuracy and reliability of a container sensing function.

In addition, after the shutdown operation time point SD, the latch circuit unit 133 may maintain the activation state of the output signal OS of the shutdown comparison unit 135 for a predetermined period of time D2 (i.e., latch time). This is to prevent the activated output signal OS from being deactivated while the first pulse signal PWM1 is inputted to the shutdown circuit unit 139.

As a result, when the output signal OS of the shutdown comparison unit 135 is activated once, the output signal OS of the shutdown comparison unit 135 may be maintained in an activated state for a predetermined period of time. Therefore, the shutdown circuit unit 139 may maintain the second pulse signal PWM2-HIN associated with the first switching element S1 in the off-state while the output signal OS is activated.

In some implementations, when the second pulse signal PWM2 (i.e., PWM2-HIN) that is in the off-state is supplied from the shutdown circuit unit 139 to the switch driving unit 150 due to the activated output signal OS, the first switching element S1 may be turned off, and as a result, no more voltage (i.e., energy) may be charged in the working coil WC.

However, even when the first switching element S1 is turned off at the shutdown operation time point SD, the voltage supplied to the working coil WC may partially increase above the predetermined resonance reference value Vr_ref after the shutdown operation time point SD, and then may decrease.

In some implementations, when the voltage supplied to the working coil WC falls below the predetermined resonance reference value Vr_ref or, the shutdown comparison unit 135 may receive a voltage value Vr less than the predetermined resonance reference value Vr_ref from the resonant current conversion unit 131, thereby deactivating the output signal OS.

In this case, the shutdown circuit unit 139 may supply the second pulse signal PWM2 (i.e., PWM2-HIN) that is in the on-state to the switch driving unit 150, and accordingly the first switching element S1 may be turned on. As a result, unnecessary energy may be further charged in the working coil WC that has already been charged.

In some implementations, the latch circuit unit 133 may maintain the activation state of the output signal OS of the shutdown comparison unit 135 for a predetermined period of time D2 (i.e., latch time) after the shutdown operation time point SD.

In some implementations, as illustrated in FIGS. 4 and 6, the shutdown circuit unit 139 may turn off the first switching element S1 and turn on the second switching element S2 after the shutdown operation time point SD. As a result, the working coil WC, second capacitor C2, and second switching element S2 may form the current flow section.

After the current flow section is formed, the working coil WC may exchange energy with the capacitor C2, and a resonant current may flow while freely resonating in the current flow section.

Here, when the object to be heated is not present on the working coil WC, the amplitude of the resonant current may be attenuated by the resistance of the working coil WC.

When the object to be heated is present on the working coil WC, the amplitude of the resonant current may be attenuated (that is, more attenuated than when no object to be heated is present) by the resistance of the working coil WC and the resistance of the object to be heated.

The sensor 120 may measure a current value Ir of the current that resonates freely in the current flow section, and may supply the measured current value Ir to the resonant current conversion unit 131. The resonant current conversion unit 131 may convert the current value Ir (i.e., current value after free resonance) to a voltage value Vr (i.e., second voltage value), and may supply the converted voltage value Vr to the count comparison unit 137 and the control unit 140.

In some implementations, a resistance value of the working coil WC may be constant, and thus the voltage has a waveform substantially the same to the current.

The count comparison unit 137 may compare the voltage value Vr with the predetermined count reference value Vcnt_ref and generate one or more output pulses OP based on a result of comparison. The count comparison unit 137 may also supply the one or more output pulses OP to the control unit 140.

Here, the one or more output pulses OP may have an on-state when the voltage value Vr is greater than the predetermined count reference value Vcnt_ref, and may have an off-state when the voltage value Vr is less than the predetermined count reference value Vcnt_ref.

The control unit 140 may determine whether or not the object to be heated is present on the working coil WC based on the one or more output pulses OP supplied from the count comparison unit 137.

For example, when a count of the one or more output pulses OP is less than a predetermined reference count, the control unit 140 may determine that the object to be heated is present on the working coil WC. On the other hand, when the count of the one or more output pulses OP is greater than the predetermined reference count, the control unit 140 may determine that no object to be heated is present on the working coil WC. Here, the count may include the number of times at which the one or more output pulses OP have changed from the off-state to the on-state.

In another example, when an on-duty time of the one or more output pulses OP is shorter than a predetermined reference time, the control unit 140 may determine that the object to be heated is present on the working coil WC. On the other hand, when the on-duty time of the one or more output pulses OP is longer than the predetermined reference time, the control unit 140 may determine that no object to be heated is present on the working coil WC. Here, the on-duty time may include an accumulated time for the on-state of the one or more output pulses OP during a period of time (i.e., D3 of FIG. 4) after the shutdown operation time point SD.

That is, the control unit 140 may accurately determine whether or not the object to be heated is present by using the count or on-duty time of the one or more output pulses OP.

When it is determined that the object to be heated is present on the working coil WC, the control unit 140 may activate the corresponding working coil WC. In addition, the control unit 140 may display whether or not the object to be heated is sensed through a display unit or an interface unit, or may notify the user whether or not the object to be heated is sensed by generating an alarm sound.

Figure 7A:
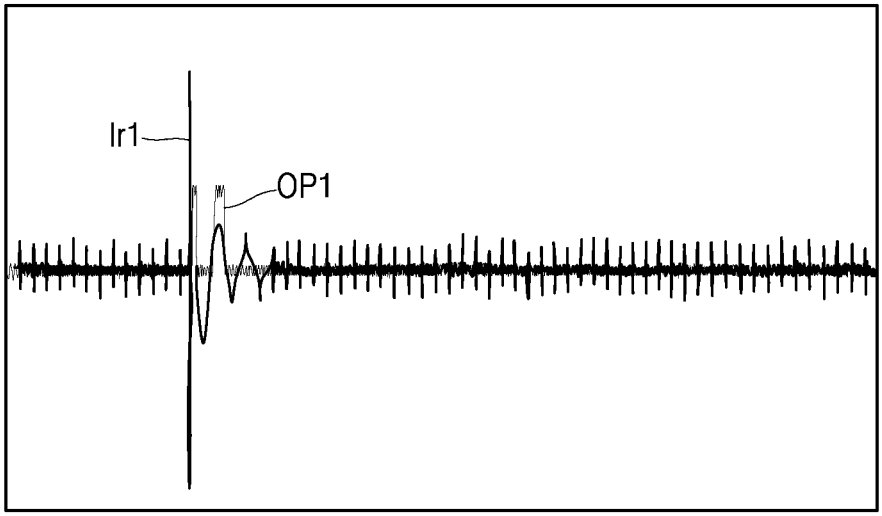
FIGS. 7A and 7B are graphs illustrating example waveforms that the induction heating device of FIG. 2 may use to determine whether or not an object to be heated is present.
Figure 7B:
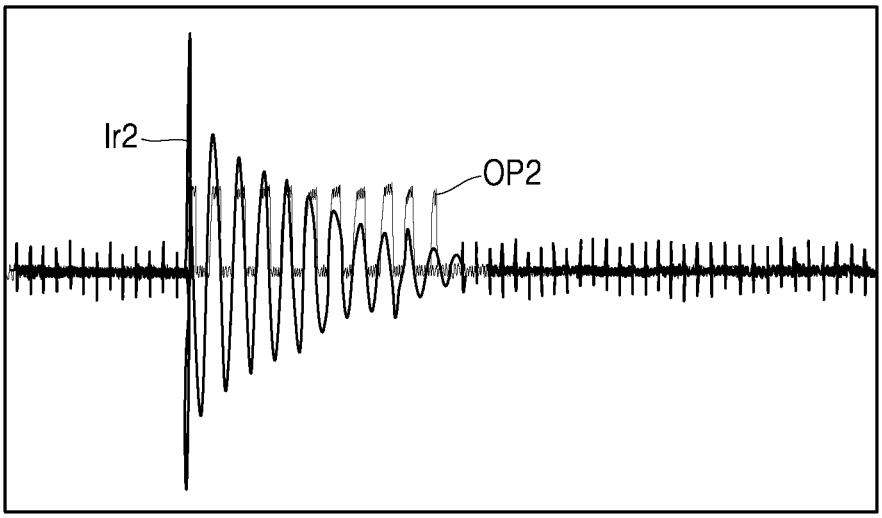

FIGS. 7A and 7B are graphs illustrating example waveforms that the induction heating device of FIG. 2 may use to determine whether or not an object to be heated is present.

FIG. 7A illustrates a waveform used when the object to be heated is disposed on the working coil WC, and FIG. 7B illustrates a waveform used when the object to be heated is not disposed on the working coil WC. FIGS. 7A and 7B illustrate merely one experimental example, and the implementations of the present disclosure are not limited to the experimental example of FIGS. 7A and 7B.

In this example, FIG. 7A illustrates a first resonant current Ir1 flowing through a working coil (WC of FIG. 2) and a first output pulse OP1 for the first resonant current Ir1. FIG. 7B illustrates a second resonant current Ir2 flowing through the working coil (WC of FIG. 2) and a second output pulse OP2 for the second resonant current Ir2.

Referring to FIGS. 2, 7A, and 7B, a count of the first output pulse OP1 is twice in FIG. 7A, and a count of the second output pulse OP2 is eleventh in FIG. 7B. That is, the count may be relatively small in number when the object to be heated is disposed on the working coil WC, and the count may be relatively large in number when the object to be heated is not disposed on the working coil WC.

Therefore, a reference count for determining whether or not the object to be heated is present on the working coil WC may be determined as a value between the count of FIG. 7A and the count of FIG. 7B. Further, the control unit 140 may determine whether or not the object to be heated is present on the working coil WC by using a predetermined reference count.

Also, an on-duty time of the first output pulse OP1 illustrated in FIG. 7A may be shorter than an on-duty time of the second output pulse OP2 illustrated in FIG. 7B. That is, the on-duty time may be relatively short when the object to be heated is disposed on the working coil WC, and the on-duty time may be relatively long when the object to be heated is not disposed on the working coil WC.

Therefore, a reference time for determining whether or not the object to be heated is present on the working coil may be determined as a value between the on-duty time of FIG. 7A and the on-duty time of FIG. 7B. Further, the control unit 140 may determine whether or not the object to be heated is present on the working coil WC by using a predetermined reference time.

That is, the control unit 140 may improve accuracy of determination as to whether or not the object to be heated is present on the working coil WC by using at least one of the count and on-duty time of the one or more output pulses OP.

Figure 8:
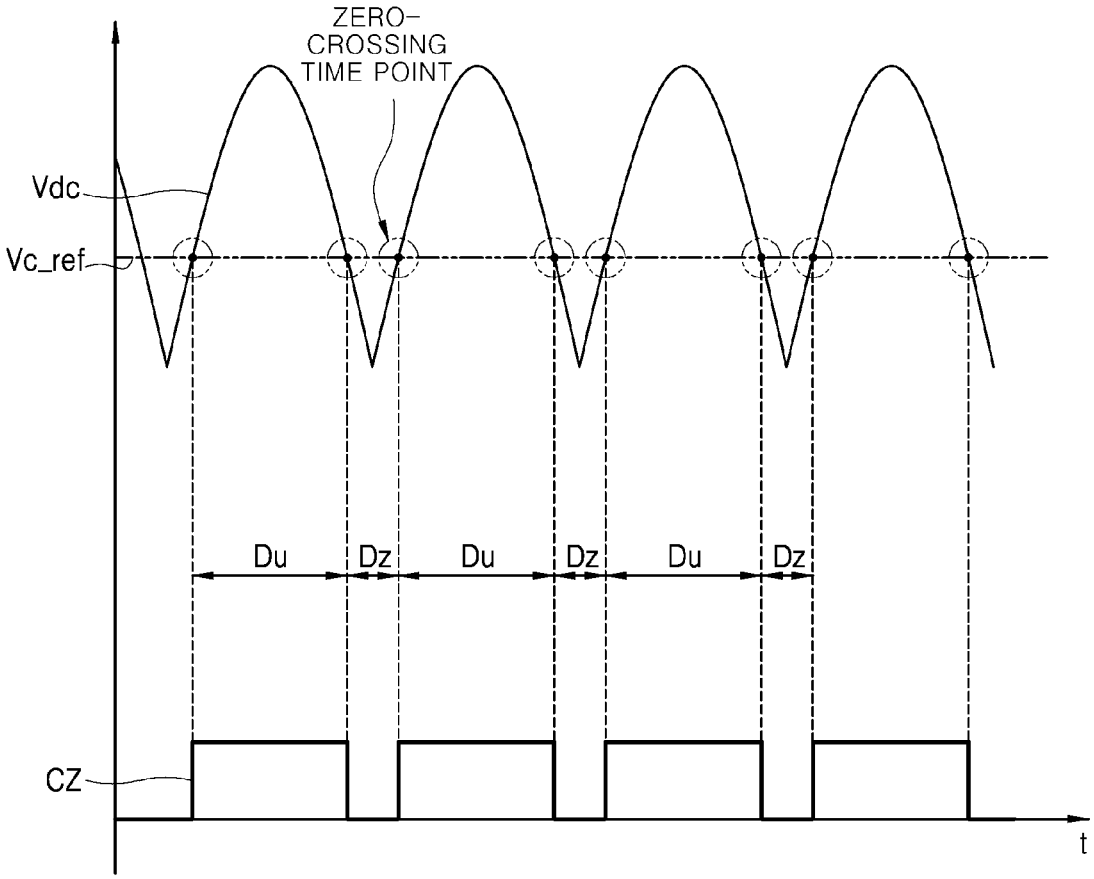
FIG. 8 is a graph illustrating example zero-crossing time points of an example input voltage applied to the induction heating unit of FIG. 2.

FIG. 8 is a graph illustrating example zero-crossing time points of an input voltage applied to the induction heating unit of FIG. 2.

FIG. 8 illustrates a rectified input voltage Vdc and a zero-voltage detection waveform CZ for the input voltage Vdc.

Referring to FIGS. 2 and 8, the input voltage Vdc may have a half-wave rectified waveform due to a rectifying operation of the rectification unit 112. For example, the input voltage Vdc may have a half-wave rectified waveform that varies on the basis of about 150V.

A time point at which the input voltage Vdc becomes equal to a predetermined reference voltage Vc_ref is referred to as a zero-crossing time point (i.e., zero-voltage time point).

Based on the zero-crossing time point, the input voltage Vdc may be divided into a first section Dz in which the input voltage Vdc is lower than the predetermined reference voltage Vc_ref and a second section Du in which the input voltage Vdc is higher than the predetermined reference voltage Vc_ref.

A variation amount of the input voltage Vdc occurring in the first section Dz may be relatively smaller than a variation amount of the input voltage Vdc occurring in the second section Du. Therefore, the control unit 140 may perform a relatively stable container sensing operation in the first section Dz.

Accordingly, the control unit 140 may perform the container sensing operation only in the first section Dz in which the input voltage Vdc is less than the predetermined reference voltage Vc_ref.

For this purpose, the control unit 140 may sense a zero-crossing time point of the input voltage Vdc and determine whether or not the object to be heated is present on the working coil WC in a section in which the input voltage Vdc is less than the reference voltage Vc_ref based on the zero-crossing time point.

Therefore, the induction heating device 100 may perform the container sensing operation only in the first section Dz, thereby improving the accuracy and reliability of the induction heating device 100 in sensing a container.

FIGS. 9 to 11B illustrate examples of a container sensing operation varying based on whether or not an input voltage applied to the induction heating unit of FIG. 2 varies.

Figure 9:
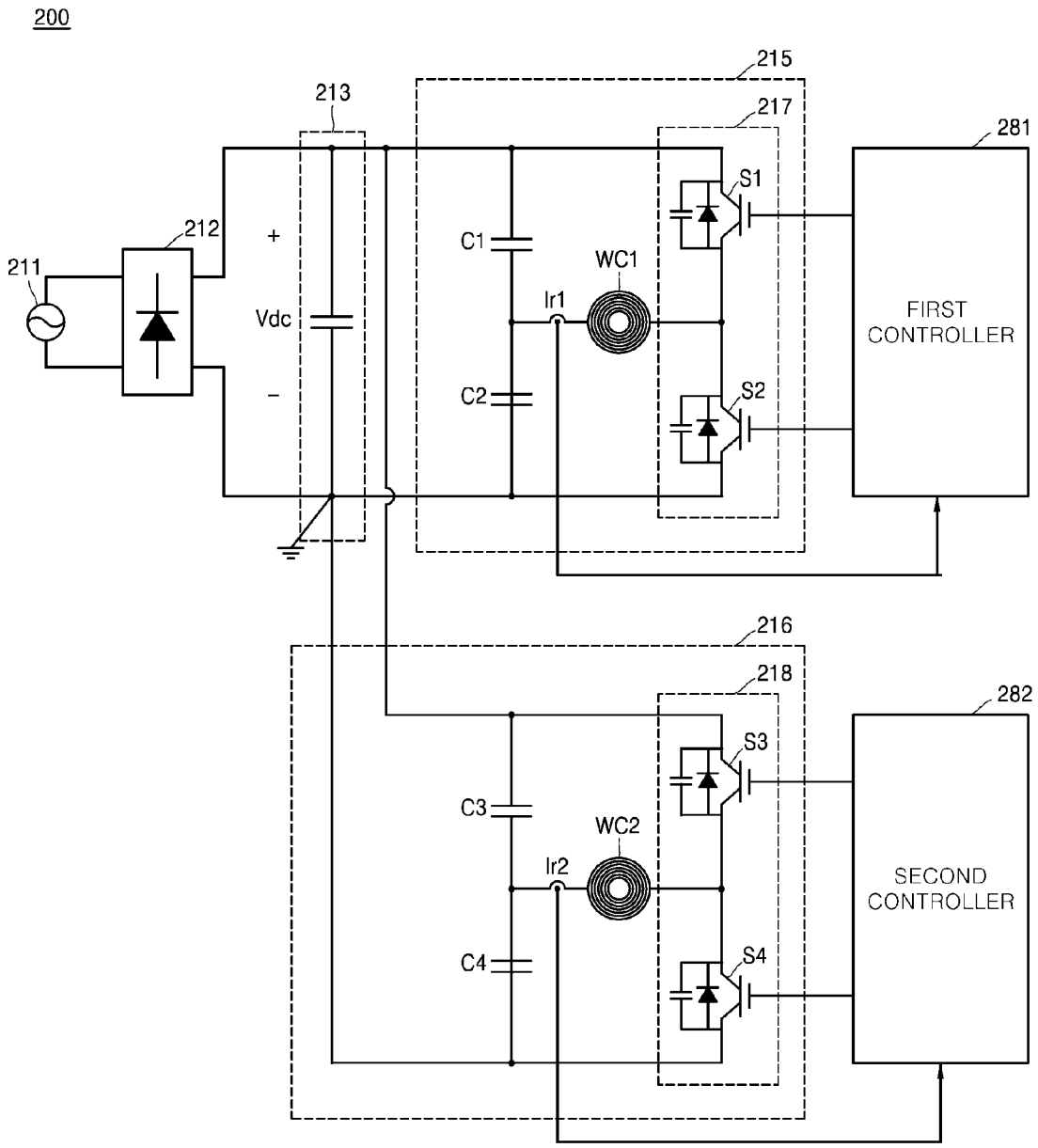
FIGS. 9 to 11B illustrate examples of a container sensing operation an input voltage applied to the induction heating unit of FIG. 2.

In some implementations, FIG. 9 is a schematic diagram of an induction heating device 200 according to another implementation of the present disclosure.

Referring to FIG. 9, the induction heating device 200 may include a first induction heating unit 215 and a second induction heating unit 216. The first induction heating unit 215 and the second induction heating unit 216 may share the same input voltage Vdc. In some implementations, the first induction heating unit 215 and the second induction heating unit 216 may be disposed adjacent to each other.

The first induction heating unit 215 may be controlled by a first controller 281 and the second induction heating unit 216 may be controlled by a second controller 282.

The first induction heating unit 215 and the second induction heating unit 216 may have substantially the same configuration as the above-described induction heating unit (115 of FIG. 2). In addition, the first controller 281 and the second controller 282 may have substantially the same configuration as the above-described controller (180 of FIG. 2). Details of the induction heating unit 115 and the controller 180 have been described above, and thus are omitted.

When the second induction heating unit 216 operates, an induced current may occur in the first induction heating unit 215.

Figure 10:
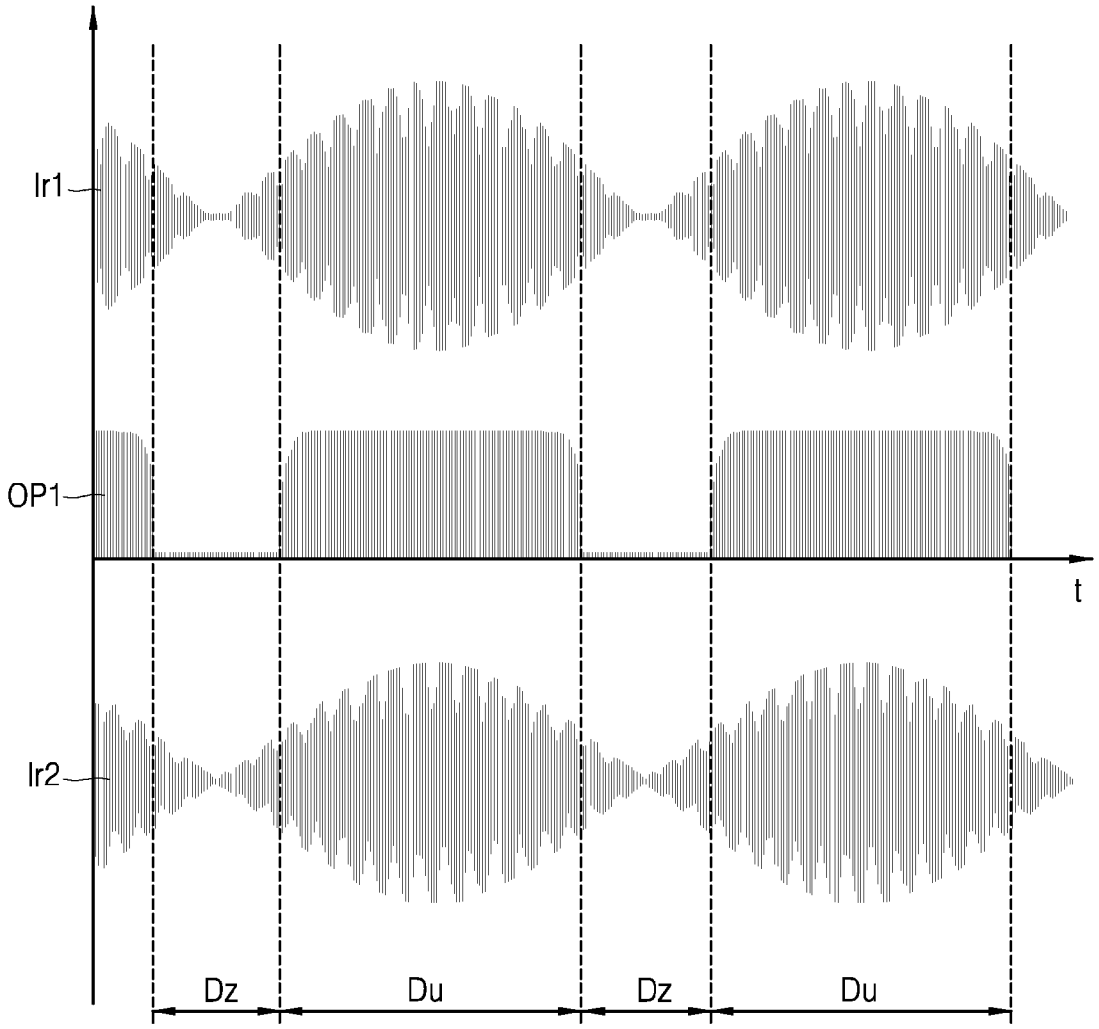

In FIG. 10, a second current Ir2 represents a current flowing through a second working coil WC2 when the second induction heating unit 216 operates. A first current Ir1 represents a current which is induced to a first working coil WC1 as the second induction heating unit 216 operates. A comparator output OP1 represents one or more output pulses outputted from the count comparison unit by the first current Ir1.

Referring to the graph of FIG. 10, the first current Ir1 may be divided into a first section Dz in which a magnitude of the first current Ir1 is smaller than a predetermined magnitude of current, and a second section Du in which the magnitude of the first current Ir1 is larger than the predetermined magnitude of current. In some examples, a boundary point between the first section Dz and the second section Du may correspond to the zero-crossing time point.

Here, it can be seen that, in the first section Dz, the comparator output OP1 is not outputted since the magnitude of the first current Ir1 induced by the operation of the second induction heating unit 216 is small.

The first controller 281 may perform the container sensing operation in the first section Dz. In other words, a control unit included in the first controller 281 may perform the container sensing operation in a section in which a current induced to the first working coil WC1 is less than a predetermined reference current (i.e., first section Dz).

As a result, the method for sensing a container may be less influenced by the operation of another working coil, thereby improving the accuracy and reliability of the container sensing operation.

Figure 11A:
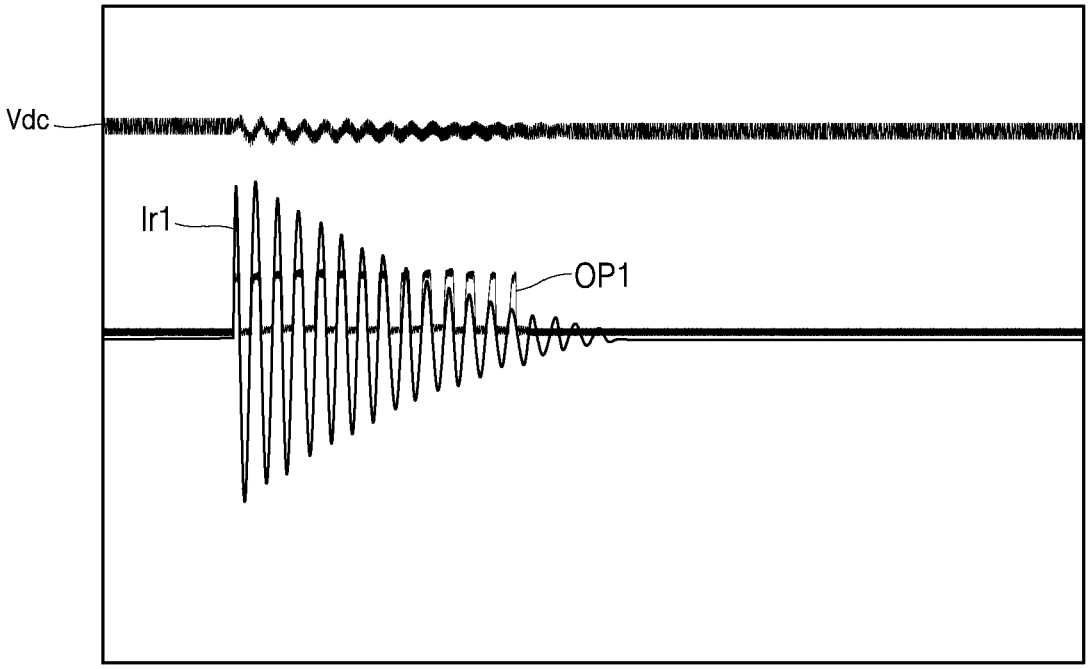
Figure 11B:
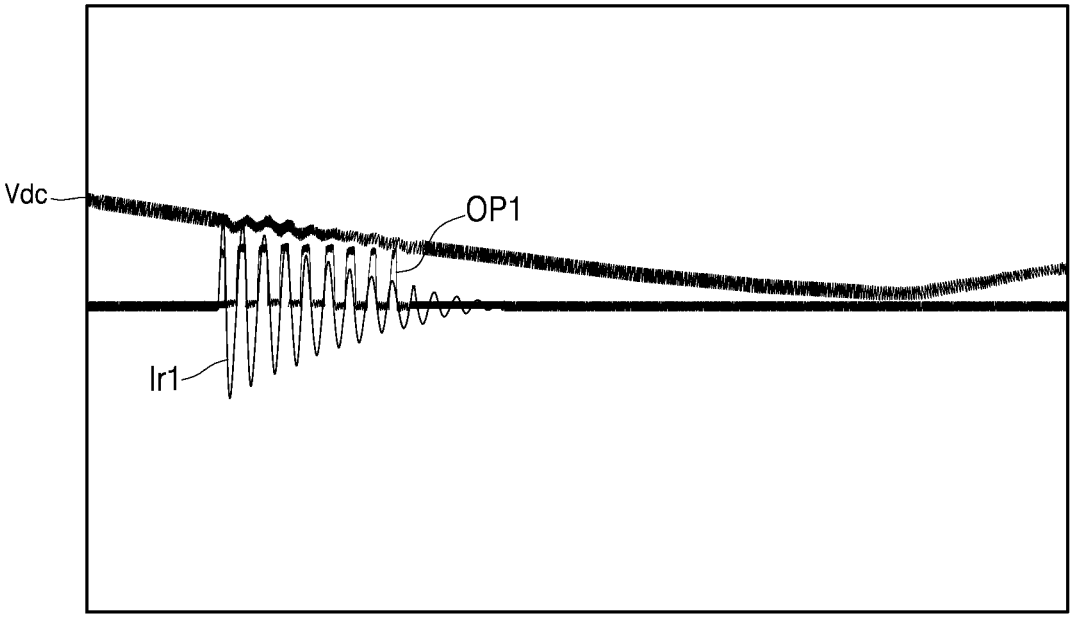

FIG. 11A is a graph illustrating a waveform appearing in the first induction heating unit 215 when the second induction heating unit 216 does not operate. FIG. 11B is a graph illustrating a waveform appearing in the first induction heating unit 215 when the second induction heating unit 216 operates.

In FIG. 11A, an input voltage Vdc having a constant magnitude may be applied to the first induction heating unit 215.

In FIG. 11B, an unstable input voltage Vdc may be applied to the first induction heating unit 215. This is a phenomenon occurring when the first induction heating unit 215 and the second induction heating unit 216 share the input voltage Vdc. The second induction heating unit 216 may use a part of the power supplied from the input voltage Vdc, and thus the magnitude of the input voltage Vdc applied to the first induction heating unit 215 may become smaller.

Therefore, when the input voltage Vdc having a constant magnitude is applied as illustrated in FIG. 11A, the control unit may transmit a single pulse having a relatively short first length (for example, 1-Pulse of FIG. 4) to a shutdown circuit unit. This is because a pulse having the first length is sufficient to charge the working coil WC.

When the unstable input voltage Vdc having a relatively small magnitude is applied as illustrated in FIG. 11B, the control unit may transmit a pulse having a second length longer than the first length to the shutdown circuit unit. This is to stably charge the working coil WC by applying a pulse having the second length longer than the first length.

In addition, the control unit may compare the variation amount of the input voltage Vdc with a predetermined variation reference value and determine a length of a single pulse to be supplied to the shutdown circuit unit based on a result of comparison.

Specifically, when the variation amount of the input voltage Vdc is greater than the predetermined variation reference value, the control unit may output a single pulse having the second length. Here, the variation reference value may correspond to a value for determining whether or not another induction heating unit operates.

For example, when the first and second induction heating units 215 and 216 share the input voltage Vdc and the second induction heating unit 216 operates, the variation amount of the input voltage Vdc applied to the first induction heating unit 215 may increase (see FIG. 11B). In this case, the control unit may output a pulse having the second length that is relatively long.

On the other hand, when the variation amount of the input voltage Vdc is less than the predetermined variation reference value, the control unit may output a single pulse having the first length shorter than the second length.

That is, a container sensing unit may generate a constant magnitude of resonant current in the working coil WC through the above-described method, thereby improving accuracy in determining that a container is sensed.

As described above, the induction heating device may operate with low power consumption and respond rapidly, thereby preventing waste of electric power and improving the user's satisfaction.

Also, the induction heating device may implement a container sensing function by adding a simple circuit, thereby reducing a cost required for a complex design change and a manufacturing process change.

The induction heating device may stably perform the container sensing operation regardless of whether or not an adjacent working coil operates or a change in input power, thereby improving the accuracy and operation reliability of the container sensing function. In addition, the induction heating device may prevent an over-current from flowing when performing the container sensing function, thereby preventing a noise resulting from the over-current.

The induction heating device may determine whether or not a cooking container is present on the working coil in real time and notify the user of a result of determination immediately, thereby improving the user's convenience.

It should be understood that these implementations are given by way of illustration only and do not limit the scope of the present disclosure, and that various modifications, variations, and alterations can be made without departing from the spirit and scope of the present disclosure defined only by the accompanying claims and equivalents thereof.

What is claimed is:

1. An induction heating device, comprising:

an induction heating circuit configured to drive a working coil, the induction heating circuit comprising an inverter connected to a first end of the working coil;

a sensor connected to a second end of the working coil and configured to measure a current applied to the induction heating circuit, the working coil being disposed between the sensor and the inverter; and a controller configured to control the induction heating circuit based on a current value of the current measured by the sensor, the controller comprising a switch driving circuit configured to control operation of the inverter and to enable a resonance of the current, wherein the controller further comprises a plurality of circuits that are configured to:

convert a first current value measured by the sensor before the resonance into a first voltage value, based on converting the first current value to the first voltage value, control operation of the switch driving circuit to charge the working coil with energy, compare the first voltage value with a predetermined resonance reference value, convert a second current value measured by the sensor after the resonance into a second voltage value, based on converting the second current value into the second voltage value, generate one or more output pulses, compare the second voltage value with a predetermined count reference value, and determine whether an object is present on the working coil based on the one or more output pulses.

2. The induction heating device of claim 1, wherein the plurality of circuits of the controller comprise:

a resonant current conversion circuit configured to convert the first current value into the first voltage value and convert the second current value into the second voltage value;

a shutdown comparison circuit configured to generate an output signal based on comparing the first voltage value with the predetermined resonance reference value;

a count comparison circuit configured to generate the one or more output pulses based on comparing the second voltage value with the predetermined count reference value; and a shutdown circuit configured to control the switch driving circuit based on the output signal and enable the resonance of the current.

3. The induction heating device of claim 2, wherein the inverter comprises:

a first switch and a second switch that are configured to be turned on and turned off based on a switching signal supplied from the switch driving circuit.

4. The induction heating device of claim 2, wherein the shutdown comparison circuit is configured to generate the output signal based on the first voltage value being greater than the predetermined resonance reference value.

5. The induction heating device of claim 2, wherein the container controller comprises:

a latch circuit connected to ends of the shutdown comparison circuit and configured to maintain an activation state of the output signal of the shutdown comparison circuit for a predetermined period of time.

6. The induction heating device of claim 2, wherein the controller is further configured to:

determine whether or not the object is present on the working coil based on comparing a count of a number of the one or more output pulses with a predetermined reference count or comparing an on-duty time of the one or more output pulses with a predetermined reference time.

7. The induction heating device of claim 6, wherein the count comprises a number of times at which the one or more output pulses are switched from an off-state to an on-state, and wherein the controller is further configured to:

determine that the object is present on the working coil based on the count being less than the predetermined reference count, and determine that the object is not present on the working coil based on the count being greater than the predetermined reference count.

8. The induction heating device of claim 7, wherein the on-duty time of the one or more output pulses comprises an accumulated time of the on-state of the one or more output pulses, and wherein the controller is further configured to:

determine that the object is present on the working coil based on the on-duty time being less than the predetermined reference time, and determine that the object is not present on the working coil based on the on-duty time being greater than the predetermined reference time.

9. The induction heating device of claim 2, wherein the controller is further configured to:

compare a variation amount of a voltage applied to the inverter with a predetermined variation reference value; and based on a result of comparison of the variation amount of the voltage with the predetermined variation reference value, determine an on-state duration of a single pulse to be supplied to the shutdown circuit.

10. The induction heating device of claim 9, wherein the controller is further configured to:

based on the variation amount of the voltage being less than the predetermined variation reference value, supply a first single pulse having a first on-state duration to the shutdown circuit; and based on the variation amount of the voltage being greater than the predetermined variation reference value, supply a second single pulse having a second on-state duration greater than the first on-state duration to the shutdown circuit.

11. The induction heating device of claim 1, wherein the controller is further configured to:

determine whether or not the object is present on the working coil in a state in which a voltage applied to the inverter is less than a predetermined reference voltage.

12. The induction heating device of claim 1, wherein the controller is configured to:

based on an induction current being induced to the working coil by operation of another working coil disposed within a range from the working coil, determine whether or not the object is present on the working coil in a state in which the induction current is less than a predetermined reference current.

13. The induction heating device of claim 1, wherein the controller comprises a first controller configured to control a first working coil and a second controller configured to control a second working coil, the first working coil and the second working coil being connected to one power source, and wherein the first controller is configured to determine whether an object is present on the first working coil based on an induced current in the first working coil induced by operation of the second working coil.

14. The induction heating device of claim 1, wherein the controller is further configured to control the switch driving circuit to charge the working coil with energy having a constant magnitude.

15. The induction heating device of claim 3, wherein a node between the first switch and the second switch is connected to a first end of the working coil, and wherein the sensor is connected to a second end of the working coil.

16. The induction heating device of claim 3, wherein each of the first switch and the second switch comprises an insulated gate bipolar transistor.

17. The induction heating device of claim 3, wherein the first switch is configured to be turned on based on the second switching switch being turned off, and wherein the first switch is configured to be turned off based on the second switch being turned on.

18. The induction heating device of claim 3, wherein the count comparison circuit is configured to generate the one or more output pulses based on the second voltage value being greater than the predetermined count reference value.

19. The induction heating device of claim 3, wherein the controller is further configured to supply a signal to the shutdown circuit, and wherein the shutdown circuit is configured to transmit the output signal to the switch driving circuit based on the signal.

20. The induction heating device of claim 3, wherein the switch driving circuit is configured to generate the switching signal based on the output signal.

* * * * *